United States Patent [19]

Emmerich

[11] 4,380,923

[45] Apr. 26, 1983

[54] VIBRATION DAMPED RIVET BUCKING TOOL

[75] Inventor: Wolfgang Emmerich, Munkhagen, Finland

[73] Assignee: Atlas Copco Aktiebolag, Nacka, Sweden

[21] Appl. No.: 307,305

[22] Filed: Sep. 30, 1981

[30] Foreign Application Priority Data

Oct. 1, 1980 [SE] Sweden ..... 8006875

[51] Int. Cl.[3] ..... B21J 15/40

[52] U.S. Cl. ..... 72/482; 29/243.54; 72/453.16

[58] Field of Search ..... 72/482, 481, 479, 465, 72/453.15, 453.16, 453.19; 29/243.54, 243.53

[56] References Cited

U.S. PATENT DOCUMENTS

| | | | |
|---|---|---|---|
| 833,878 | 10/1906 | Gunnell | 72/482 |
| 1,442,675 | 1/1923 | Lembcke | 72/482 |
| 1,480,464 | 1/1924 | Pungs | 72/482 |
| 2,274,091 | 2/1942 | Pavlecka | 29/243.54 |
| 2,349,341 | 5/1944 | Disse | 72/481 |
| 2,411,561 | 11/1946 | Stevens | 29/243.54 |

FOREIGN PATENT DOCUMENTS

| | | |
|---|---|---|
| 138918 | 12/1901 | Fed. Rep. of Germany . |
| 167128 | 4/1905 | Fed. Rep. of Germany . |
| 171067 | 6/1906 | Fed. Rep. of Germany . |
| 183481 | 5/1907 | Fed. Rep. of Germany . |
| 618834 | 9/1935 | Fed. Rep. of Germany . |

*Primary Examiner*—Gene Crosby

*Attorney, Agent, or Firm*—Frishauf, Holtz, Goodman & Woodward

[57] ABSTRACT

A rivet bucking tool (10) is provided with a damping piston (13) actuated by air pressure in a damping chamber (42) of the tool housing (11) of sufficient volume to isolate the housing (11) from undesirable vibration. The piston (13) forms an assembly with a bucking die (23) so as to inertially restrain recoil jointly therewith. A pressure reduction valve (28) is provided on the tool (10) for selectively setting the pressure in the damping chamber (42) to produce an elastic force bias on the assembly approximately equal to the optimal manual bucking force required for properly forming the rivet head and bucking in the riveting work at hand.

6 Claims, 4 Drawing Figures

30
37
31
38
32
28
39
29
33
41
40
34
35
36
12
42
11
14
10
44
13
19
26
16
18
17
15
25
43
20
27
21
2
2
24
23
57
53
54
55
56

40
34
47
39
28
29
31
30
52
38
51
50
33
41
35
49
48
46
42
12
10
44
11
13

26
25
24
23'
57
58

20
22
11
21

VIBRATION DAMPED RIVET BUCKING TOOL

BACKGROUND OF THE INVENTION

This invention relates to vibration damped rivet bucking tools of the type including a housing subjectable to a manual bucking force, a cylinder bore in said housing, abutment means at one end of said cylinder bore, a piston sealingly and reciprocally disposed in said cylinder bore and defining a damping chamber at the other end thereof, a rivet bucking die connected to said piston at said one end of said cylinder bore to form an assembly with said piston and applicable by said manual force against a rivet to be bucked, and passage means for supplying compressed air to said damping chamber to cooperate with said piston for transmitting said manual force thereto and to said die during rivet bucking.

In similar previous devices, suggested for example in U.S. Pat. No. 2,274,091, a counterspring, a relatively small air volume behind the large diameter damping piston and a small joint mass of the piston and die were apt to cause high and poorly damped forces in the housing. Furthermore no means were provided to adapt the bucking operation to variations in the work conditions such as variation in size and hardness of the rivets, the size of the holes, etc.

SUMMARY OF THE INVENTION

It is the main object of the invention to create a vibration damped bucking tool of the abovementioned type having improved recoil and vibration damping properties and easy adaptation to changing work conditions, thus causing less fatigue and increased convenience during continued bucking work. These and further objects and advantages of the invention will be apparent from the description following hereinafter and are in particular attained by what is stated in this specification in the characterizing features of the claims thereof.

DETAILED DESCRIPTION

Figure 1:
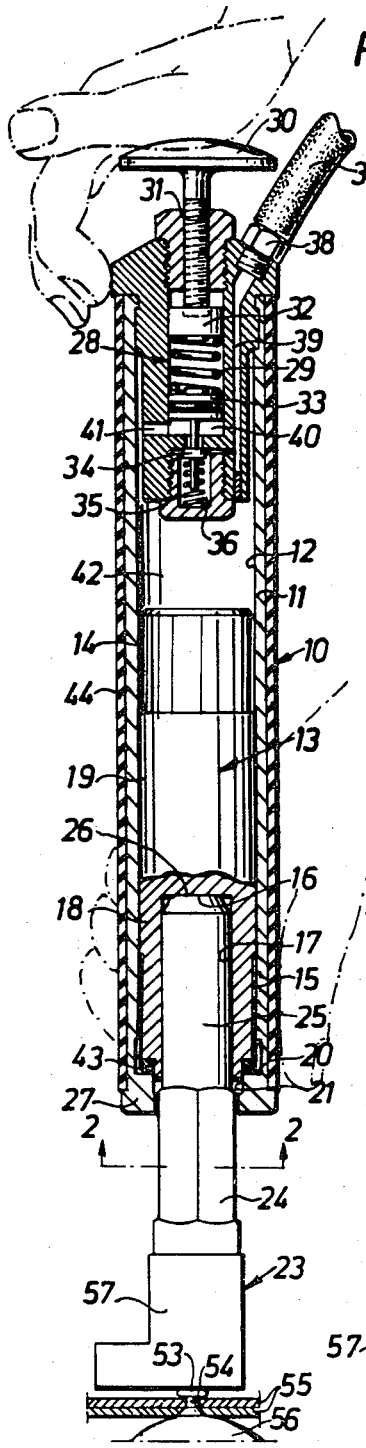
FIG. 1 is a longitudinal section through a straight hand held bucking tool according to the invention during work.

The bucking tool 10 in FIG. 1 has an elongated housing 11, a front wall 27 and a cylinder bore 12 extending rearwardly therefrom. A damping member or piston 13 is slidably and sealingly movable in cylinder bore 12 and has a slightly reduced rear portion 14 and a similarly reduced front portion 15 in order to ease its reciprocation in cylinder bore 12. Piston 13 has a piston head 19 and along its central axis a forwardly directed blind bore or socket 17 defining a skirt 18 therearound.

Figure 2:
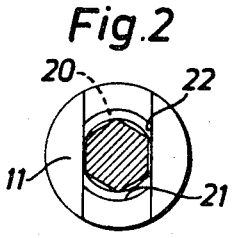
FIG. 2 is a partly sectional view on the line 2—2 in FIG. 1.

The skirt 18 is terminated by a transverse anvil surface 16 in socket 17. The front wall 27 of housing 11 has an annular internal abutment shoulder 20, a central internal bore 21 and an outer transverse slit 22, FIG. 2, communicating with bore 21 and thus providing access to the interior of cylinder bore 12 and to socket 17 of piston 13 therein. A variety of conventional bucking dies 23, of which only one is shown in FIG. 1, is provided for the bucking tool 10. Each die 23 has an intermediate hexagonal portion 24 and a cylindrical shank 25, the latter fitting slidably in socket 17 of piston 13 with a frictional and substantially sealing fit. The shank can removably be inserted to bottom in socket 17 through the opening defined by slit 22 and bore 21 in front wall 27 and abuts by its end face 26 against anvil surface 16. In this and in working position hexagonal portion 24 will cooperate with the opposite ridges of slit 22 to prevent rotation of die 23 relative to housing 11.

The rear end of cylinder bore 12 is closed by a valve 28, incorporating a pressure reduction valve assembly of any suitable conventional design, here illustrated as having an adjustment spring 29 therein. By a knob 30, a screw spindle 31 and a plug 32, spring 29 can be selectively loaded to apply a counter force against a sealed balancing plunger 33 loaded by the air pressure in a reduction chamber 40 adjacent thereto. Balancing plunger 33 is in cooperating contact with a reduction valve disk 34 of smaller diameter. A relatively weak counterspring 35 in a valve chamber 36 upstream of disk 34 urges disk 34 to closed position and against balancing plunger 33 in chamber 40. Compressed air is supplied to chamber 36 from an outer source, not shown, via a hose 37 connected to a nipple 38 on valve 28, and via a passage 39 in said housing. Reduction chamber 40 communicates via a wide passage 41 with cylinder bore 12 creating therein an air cushion in a damping chamber 42 behind piston 13. As evident from the described arrangement of the parts in valve 28, axial adjustment of knob 30 will alter the load on spring 29, whereby the pressure in reduction chamber 40 can be increased or decreased at will and the pressure in damping chamber 42 thus selected to exactly suit the working requirements, i.e. give optimum recoil and vibration damping. The air cushion in damping chamber 42 by its pressure acts as an elastic means to bias piston 13 in forward direction towards a limit stop provided by fixed abutment shoulder 20 and buffer means, preferably an O-ring 43, forwardly on piston skirt 18 or as an alternative supported adjacent shoulder 20. The O-ring 43 between piston 13 and shoulder 20 serves to resiliently dampen forward butting of piston 13 upon shoulder 20. A rubber sleeve 44 is provided on and around housing 11 for more pleasant handling during work.

Figure 4:
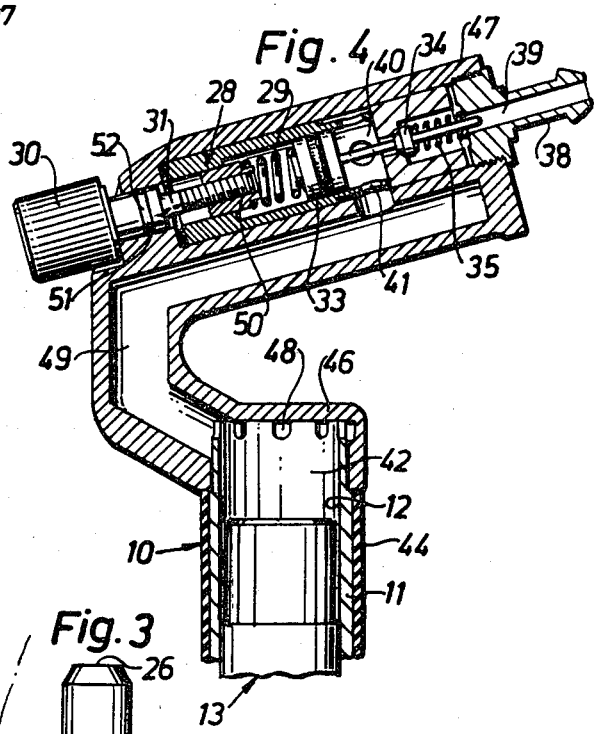
FIG. 4 is a fragmentary longitudinal section through a modified embodiment incorporating a rear hand grip.

Preferably in the embodiments shown in FIGS. 1 and 4 the housing 11 is given a size so as to provide a diameter for cylinder bore 12 in the order of 3–5 centimeters. That permits the housing 11 to be conveniently gripped and directed by the operator's hands as indicated in dot and dash lines in FIG. 1 with housing 11 encircled by the flat of one hand and the palm of the other applied mainly on knob 30. The manual force to be excerted by the operator on the tool 10 during bucking will normally and desirably be below 10 k.p., preferably in the order of 2–5 k.p. depending on the material and hardness of the rivets to be bucked. The balancing pressure for the damping chamber 42 will be chosen in the order of 1.3 to 2.5 bar so as to normally produce an elastic force by the air cushion in chamber 42 approximately equal to the optimal manual force required for properly bucking the riveting work at hand.

In order to reduce recoil the piston 13 and die 23 are elongated massive bodies chosen to recoil jointly as a single inertial body. For good inertial damping the piston and die assembly is made of steel with piston 13 provided with a piston head 19 having a length of between 1.5 to 3 times the diameter thereof. The skirt 18 in such case preferably has a length of 1.5 to 2 times that diameter.

In operation the bucking tool 10 is connected to a source of compressed air and the pressure in damping chamber 42 is set by the operator by knob 30 to provide the estimated desired elastic force on piston 13 and bring it to butt resiliently by buffer O-ring 43 on shoulder 20. As aforesaid said elastic force is chosen approximately equal to the normal or optimal manual bucking force expected for the work at hand. The bucking tool by its protruding die 23 is then placed on the rivet head to be bucked or alternatively, as shown in FIG. 1, on the shank of the rivet 54 to be headed over the work sheets 55 by bucking.

Simultaneously therewith another operator has applied and presses the riveting hammer with its working end 56 against the opposite head end of the rivet. The riveting hammer, not shown, may be of any suitable conventional design, preferably being vibration damped, e.g. made according to U.S. patent application Ser. No. 256,148. A bucking force is then applied on housing 11 in order to keep die 23 firmly on the rivet countered by working end 56 and sufficient to move piston 13 slightly inwardly against the elastic force produced by the air cushion in damping chamber 42 so as to always release during bucking the butting load on buffer O-ring 43. This prevents during subsequent operation of the riveting hammer the housing 11 from being subjected to vibration during forward return of piston 13 after recoil.

The riveting hammer is then started to deliver blows to the rivet head by working end 56. The impact from each blow is transmitted through the rivet 54 as a shock or stress wave which travels on through die 23 and piston 13 causing inertially damped recoil of the die and piston assembly and reduction and final absorption of the shock wave energy by the elastic force of the air cushion in damping chamber 42, the latter acting as a recoil dampener and restraining transmission of harmful vibration to housing 11. The size or volume of damping chamber 42 is chosen several times the displacement volume under recoil of piston 13 during bucking, sufficiently to reduce vibration due to pressure pulsations to an insignificant level and thus to isolate housing 11 from undesirable vibration.

After a test run on the particular type of rivet to be headed, the operator by adjustment of knob 30 will find the more exact working pressure to be maintained in air cushion of damping chamber 42 in order to elastically bring the piston and die assembly back to butt on the rivet 54 before the next recoil generating blow is delivered by the riveting working end 56. This working pressure, when optimal, should be sufficient to rapidly form as a result of the bucking operation and by cold deformation of the rivet shank, a head 53 thereon having a diameter approximately 1.5 times the diameter of the rivet shank and a thickness of about half said diameter. During bucking work the operator will maintain his manual bucking force substantially equal to the elastic force produced by the air cushion in damping chamber 42. He will have to follow the proceeding deformation of the rivet head so as to always keep the O-ring buffer 43 substantially released from piston 13 and thus the housing 11 protected from forward piston return impacts. The transition from load to release of the buffer 43 is in practice easily sensed by the operator due to the distinctly perceptible disappearence of vibration. With increasing diameter and hardness of the rivets to be bucked, the pressure in damping chamber 42, i.e. the bucking force, should normally be increased in order to head the rivets properly and to bring the recoiling piston and die assembly back in time on the shank of the rivet 54. Thanks to the fact that the open socket 17 of piston 13 allows rapid exchange of bucking dies through openings 21, 22, the operator can select for the work at hand from his set of dies of different shape and/or weight, the one die best suited to be used conveniently and to reduce recoil of the damping system. Substituting in particular the die 23 for a heavier one, the inertia of the total bucking mass can be increased, for example when heading hard duraluminium or titanium rivets, so as to reduce recoil and to avoid excessive increase of the pressure in air cushion of damping chamber 42.

Figure 3:
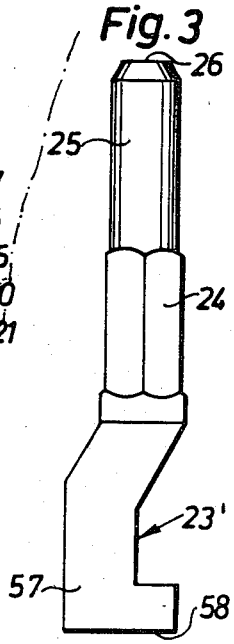
FIG. 3 is a side view of an alternative die for the tool in FIG. 1.

The die 23' in FIG. 3 represents an example of an exchange die for the tool 10 in FIG. 1 having a die head 57 of modified shape in order to rivet aircraft framework of different complex form. Die head 57 has a flat rivet forming front surface 58 similarly to the die 23 shown in FIG. 1.

In the embodiment of FIG. 4 the tool 10 is provided with a backhead 46 on its housing 11 carrying a hand grip 47. Apertures 48 at the rear end of cylinder bore 12 communicate the air cushion 42 therein via a passage 49 in the hand grip 47 with passage 41 of valve 28. In this embodiment valve 28 is provided in hand grip 47 in alignment with air supply nipple 38. The adjustment knob 30 of valve 28 is rotatably journalled in hand grip 47 and kept in place axially by a transverse pin 51 cooperating with a groove 52 in screw spindle 31 of knob 30. By rotation of knob 30 screw spindle 31 actuates an axially displaceable square slide 50 to adjust spring 29 and thus the load acting on balancing plunger 33. Operation of the tool in FIG. 3 is the same as the tool described with reference to FIG. 1, the only difference lying in the use of hand grip 47.

I claim:

1. A vibration damped rivet bucking tool comprising a housing (11) subjectable to a manual bucking force, a cylinder bore (12) in said housing, abutment means (20) at one end of said cylinder bore, a piston (13) sealingly and reciprocally disposed in said cylinder bore and defining a damping chamber (42) at the other end thereof, a rivet bucking die (23) connected to said piston (13) at said one end of said cylinder bore to form an assembly with said piston and applicable by said manual force against a rivet to be bucked, and passage means (39) for supplying compressed air to said damping chamber to cooperate with said piston for transmitting said manual force thereto and to said die during rivet bucking, characterized by said damping chamber (42) of said cylinder bore (12) having a volume exceeding the displacement volume of said piston (13) under recoil during rivet bucking sufficiently to isolate said housing (11) from undesirable vibration, and pressure reduction valve means (28) on said housing (11) connected to said passage means (39) for selectively adjusting the air pressure in said damping chamber (42) so as to bias said piston and die assembly (13, 23) onto said abutment means (20) by an elastic force approximately equal to the optimal manual force required for proper rivet heading and bucking in the riveting work at hand.

2. A tool according to claim 1 in which resilient buffer means (43) are provided between said piston (13) and said abutment means (20) to resiliently define a fixed axial position for said piston (13) in said housing (11).

3. A tool according to claim 1 in which said piston (13) and die (23) are elongated massive bodies adapted to reduce by inertia their joint recoil during bucking.

4. A tool according to claim 3 in which the diameter of said piston (13) is chosen to permit said housing (11) therearound to be gripped and substantially encircled by the flat of the hand of the bucking operator.

5. A tool according to claim 4 in which said piston (13) has a head (19) thereon having a length of between one and a half to three times the diameter thereof.

6. A tool according to claim 4 or claim 5 in which the air pressure in said damping chamber (42) is set by said valve means (28) to between 1.3 to 2.5 bar.

* * * * *